US011317752B2

(12) United States Patent
Arnold et al.

(10) Patent No.: US 11,317,752 B2
(45) Date of Patent: May 3, 2022

(54) SHOWER/TUB WALL INCLUDING A BRACKETLESS CURTAIN ROD

(71) Applicant: Delta Faucet Company, Indianapolis, IN (US)

(72) Inventors: Robert Arnold, Greensburg, IN (US); Donald Joseph King, III, Marlette, MI (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 16/730,200

(22) Filed: Dec. 30, 2019

(65) Prior Publication Data

US 2021/0196072 A1 Jul. 1, 2021

(51) Int. Cl.
*A47H 1/102* (2006.01)
*A47K 3/38* (2006.01)

(52) U.S. Cl.
CPC ..... *A47H 1/102* (2013.01); *A47K 3/38* (2013.01)

(58) Field of Classification Search
CPC . A47H 1/102; A47H 1/12; A47H 1/14; A47H 1/104; A47H 1/122; A47K 3/38
See application file for complete search history.

(56) References Cited

U.S. PATENT DOCUMENTS 805,570 A * 11/1905 Maldaner ..... A47H 1/142 248/264
1,752,683 A * 4/1930 Meagher ..... A24B 1/08 248/251
5,134,806 A * 8/1992 Burkart, Jr. ..... E06B 9/02 49/463
6,845,955 B1 * 1/2005 Hsu ..... A47K 3/38 211/123
7,055,188 B2 * 6/2006 Ross ..... A47K 3/30 4/609
8,166,583 B1 5/2012 Liang
8,231,093 B2 7/2012 Tran
9,051,736 B2 6/2015 Geels et al.
9,226,623 B2 1/2016 Geels et al.
9,427,612 B1 8/2016 Swanson
9,506,253 B2 11/2016 Rosko et al.
(Continued)

FOREIGN PATENT DOCUMENTS

CN 101902944 A 12/2010
CN 202143569 U 2/2012
(Continued)

OTHER PUBLICATIONS

Leuschen Wolfgang EP1444930A2_translate.pdf (Year: 2004).*

*Primary Examiner* — Babajide A Demuren
(74) *Attorney, Agent, or Firm* — Bose McKinney & Evans LLP

(57) ABSTRACT

The present disclosure relates generally to molded rod mounts for shower/bathing systems. In particular, the present disclosure provides at least one molded rod mount having a first wall body including a first recess configured to receive a first end of a rod. The first recess includes an axis perpendicular to the first wall body, a first curved portion having a first depth and a first radius of curvature relative to the axis, and a first rear portion adjacent to the first curved portion. A second recess is disposed opposite the first recess on a second wall body opposite the first wall body.

13 Claims, 6 Drawing Sheets

(56) References Cited

U.S. PATENT DOCUMENTS

| | | | | |
|---|---|---|---|---|
| 9,526,379 | B2 | 12/2016 | Hoernig et al. | |
| 9,554,674 | B2 | 1/2017 | Forrest et al. | |
| 9,949,588 | B1 | 4/2018 | Stine | |
| 10,165,904 | B2 | 1/2019 | Biagi et al. | |
| 2004/0178310 | A1 | 9/2004 | Marion | |
| 2005/0229303 | A1 | 10/2005 | Ross et al. | |
| 2006/0070966 | A1 | 4/2006 | Koudys et al. | |
| 2007/0006378 | A1 | 1/2007 | Moore | |
| 2007/0169260 | A1* | 7/2007 | Huang | A47K 3/38 4/558 |
| 2009/0094737 | A1* | 4/2009 | Tracey | E03C 1/0408 4/601 |
| 2010/0115694 | A1 | 5/2010 | Lin | |
| 2013/0276224 | A1 | 10/2013 | Kitfield | |
| 2013/0276225 | A1 | 10/2013 | Kitfield | |
| 2017/0280942 | A1 | 10/2017 | Fraley | |

FOREIGN PATENT DOCUMENTS

| | | | | |
|---|---|---|---|---|
| DE | 29805331 | U1 | 6/1998 | |
| EP | 1444930 | A2 * | 8/2004 | A47H 1/142 |
| FR | 2753070 | | 11/1996 | |
| WO | 2012072988 | A2 | 6/2012 | |

* cited by examiner

SHOWER/TUB WALL INCLUDING A BRACKETLESS CURTAIN ROD

BACKGROUND AND SUMMARY

The present disclosure relates generally to bathing systems for receiving a bracketless curtain rod. In particular, the present disclosure provides a shower/tub system, such as molded walls or panels for bathroom tub and shower installations, configured to receive and securely mount a curtain rod without the use of tools or mechanical fasteners.

The demand for more do-it-yourself (DIY) friendly bathroom building materials that are attractive, functional, and easy to install is ever increasing. Bathing systems having a showerhead, for example, may further include a curtain rod for holding a curtain to prevent water from spraying to undesired areas of the bathroom. However, typically such curtain rods require tools and mechanical fasteners for installing securely to opposing walls. Shower/tub systems having a clean design are desired to satisfy consumer demand. Simple to install curtain rods that do not require tools or mechanical fasteners are desired to provide functional and attractive bathing system solutions.

These and other needs are addressed by the various aspects and configurations of the present disclosure.

According to an illustrative embodiment of the present disclosure, a molded rod mount for a shower system includes a first wall body having a first recess configured to receive a first end of a rod. The first recess includes an axis perpendicular to the first wall body, a first curved portion having a first depth and a first radius of curvature relative to the axis, and a first rear portion adjacent to the first curved portion, the first rear portion being parallel and offset relative to a first wall body planar surface at a distance equal to the first depth. The molded rod mount further includes a second recess configured to receive a second end of the rod, the second wall body being opposite the first wall body and the second recess being opposite the first recess. The second recess includes the axis perpendicular to the second wall body and the first wall body, a second curved portion having a second depth and a second radius of curvature relative to the axis, and a second rear portion adjacent to the second curved portion, the second rear portion being parallel and offset relative to a second wall body planar surface at a distance equal to the second depth. At least one of the first recess further includes first and second side portions extending upward from the first curved portion, the first and second side portions having the first depth, and the second recess further includes third and fourth side portions extending upward from the second curved portion, the third and fourth portions having the second depth.

According to another illustrative embodiment, a bathing system includes a molded rod mount, the molded rod mount including a first wall body having a first recess configured to receive a first end of a rod. The first recess includes an axis perpendicular to the first wall body, a first curved portion having a first depth and a first radius of curvature relative to the axis, and a first rear portion adjacent to the first curved portion, the first rear portion being parallel and offset relative to a first wall body planar surface at a distance equal to the first depth. The first recess further includes first and second side portions extending upward from the first curved portion, the first and second side portions having the first depth.

According to another illustrative embodiment, a method of forming a bathing system for receiving a rod includes molding a polymer to form a one-piece construction bathing system including at least one molded rod mount, the at least one molded rod mount having a recess configured to receive an end of a rod. The recess includes an axis perpendicular to a first wall body, a curved portion having a first depth and a radius of curvature relative to the axis, and a rear portion adjacent to the curved portion, the rear portion parallel and offset relative to a first wall body planar surface at a distance equal to the first depth.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION

The embodiments of the invention described herein are not intended to be exhaustive or to limit the invention to precise forms disclosed. Rather, the embodiments selected for description have been chosen to enable one skilled in the art to practice the invention.

The present disclosure relates generally to bathing and/or shower systems or enclosures having a molded rod mounting system for receiving a shower curtain rod for holding a shower curtain. In particular, the present disclosure provides molded recesses disposed at opposing walls of the shower system for securely holding a shower curtain rod without the use of mechanical fasteners (e.g., clips, nails, screws, staples, etc.) and without the need of tools for installation. The present disclosure addresses the need for providing simple to install shower/tub systems having the clean lines and architectural bathroom styles on-trend and in demand, while obviating the need for mechanical fasteners. Thus, a finished bathroom may be achieved in a time-efficient and cost-efficient manner with attractive results.

Figure 1:
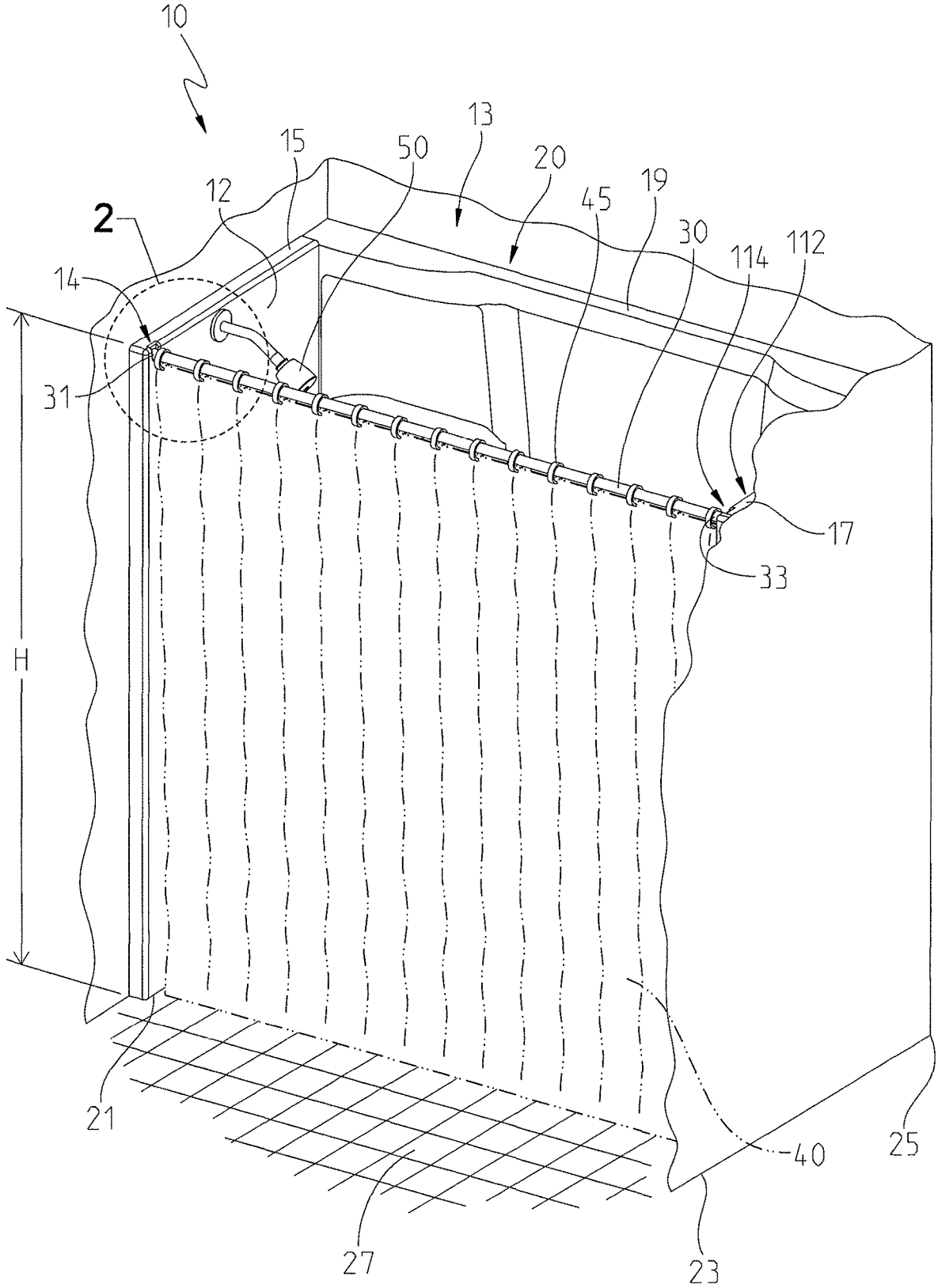
FIG. 1 is a perspective view of an illustrative shower system including a molded rod mount according to the present disclosure.

Various aspects of the present disclosure include a shower/tub system 10 as shown in FIG. 1 having a shower head 50 for dispensing water extending from wall body 12 of wall set assembly or system 20. System 20 may define, for example, a tub enclosure, a shower enclosure, a bathing enclosure, or a combination thereof (e.g., shower/tub enclosure). Illustratively, system 20 may be formed of separate molded panels (e.g., left wall panel or body 12, right wall panel or body 112 and/or rear wall panel or body 13) that define the wall body 12. The panels 12, 112, 13 include an upper edge 15, 17, and 19, respectively. Upper edge 15 of panel 12 is above shower head 50 to allow room to mount the shower head 50. Panels 12, 112, 13 include a lower edge 21, 23, and 25, respectively which are proximate a water collecting surface 27 that collects water dispensed by shower head 50. The shower/tub system 10 includes a shower curtain rod 30 for holding a shower curtain 40 via conventional hooks or rings 45. Shower curtain 40 is configured to retain the water dispensed by shower head 50 within the system 20. Area 2 of FIG. 1 is illustrated in greater detail in FIG. 2.

Figure 2:
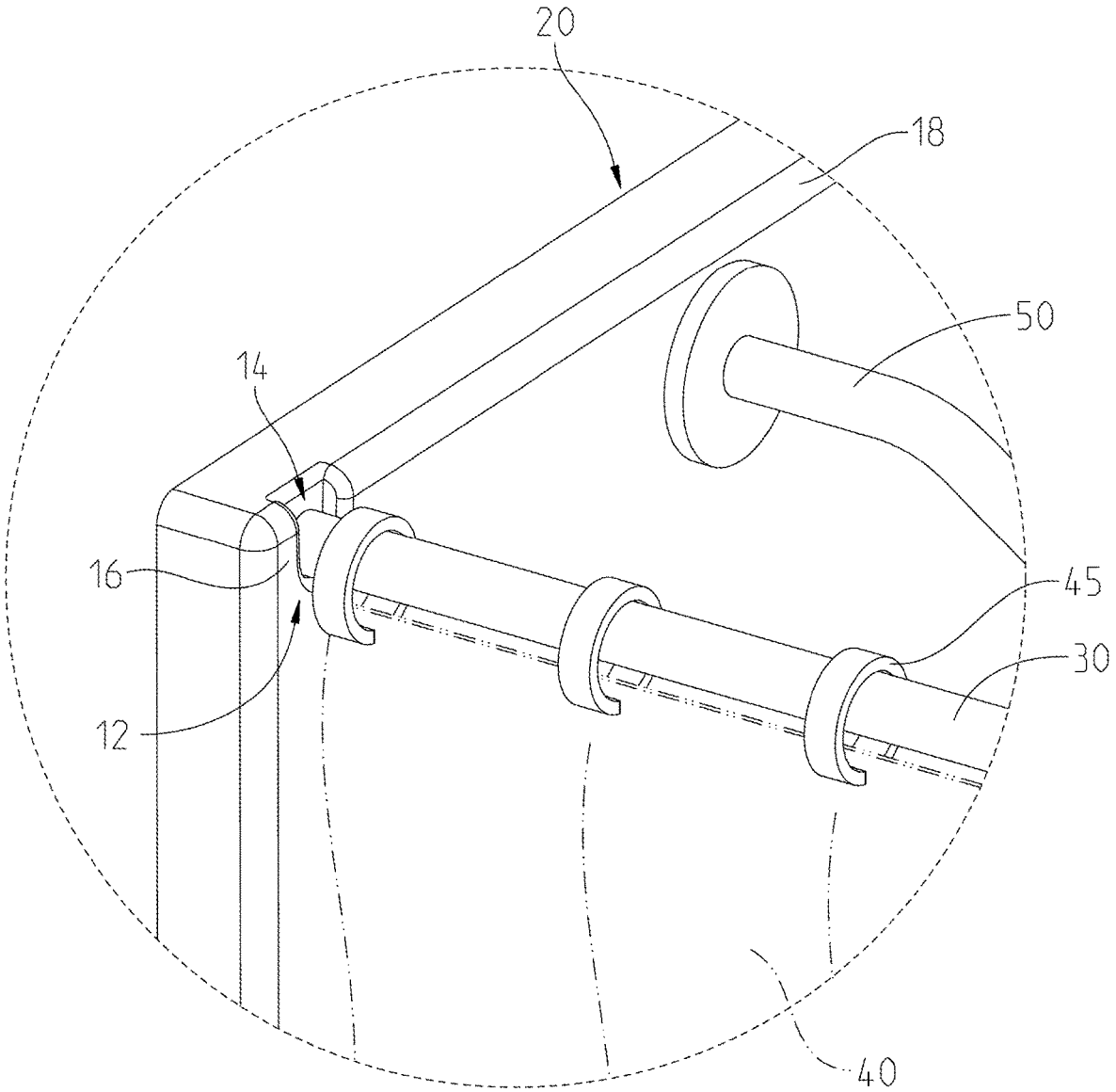
FIG. 2 is a perspective view of the molded rod mount as shown in Area 2 of FIG. 1.

Shower curtain rod 30, referred to interchangeably herein as simply rod 30, as shown in FIG. 2 is mounted in recess 14 in wall body 12 of system 20. Shower curtain rod 30 may be of conventional design, such as a tension curtain rod including opposing ends 31 and 33 axially biased away from end other. Recess 14 illustratively defines a molded rod mount configured to receive, accommodate, and support conventional shower curtain rods, such as rod 30, for ease of mounting and for security during use. Advantageously, system 20 including recess 14 may be made of a polymer molded in a single, one-piece construction with wall body 12. Alternatively, system 20 may be formed of a multi-piece construction including a plurality of separate wall components.

Wall body 12 of system 20 having a wall body planar surface 16 may optionally also include at least one additional surface having a decorative contour, e.g., decorative surface 18, adjacent to wall body planar surface 16. Decorative surface 18 provides for aesthetically smooth lines for clean design molded bathing systems according to the present disclosure. For example, decorative surface 18 may be one of rounded, chamfered, beveled, filleted, angled, sloped, and combinations thereof.

Figure 3:
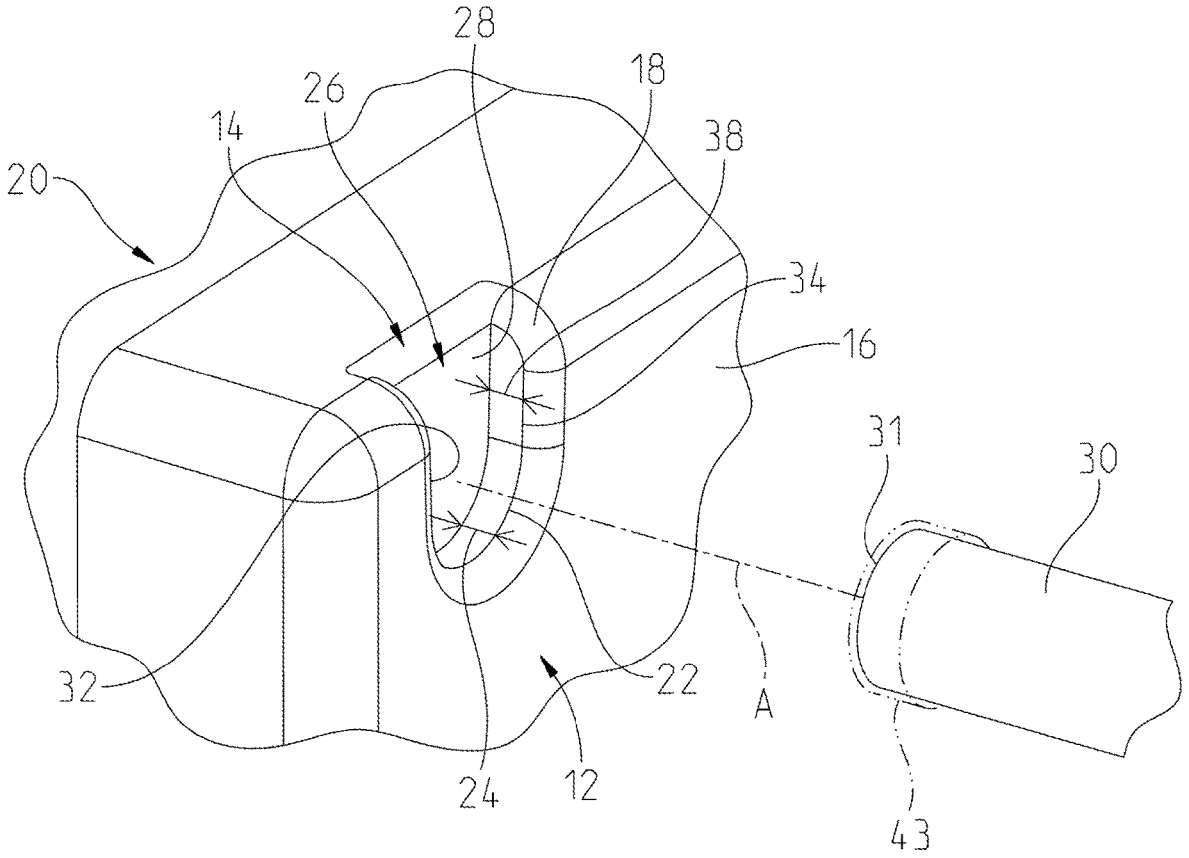
FIG. 3 is an exploded perspective view of the molded rod mount of FIG. 2.

FIG. 3 illustrates an exploded perspective view of system 20 having recess 14 as in FIG. 2 for receiving rod 30. Wall body 12 including recess 14 is configured to receive a first end 31 of rod 30. Recess 14 includes an axis A extending perpendicular wall body 12 and parallel to curtain rod 30 when coupled within system 20. Wall body 12 includes planar surface 16. Recess 14 includes a first curved portion 22 having a depth 24 and a radius of curvature R relative to the axis A. Recess 14 includes a rear portion 26 adjacent to the curved portion 22, wherein rear portion 26 includes a rear surface 28 parallel to and offset (i.e., recessed) relative to wall body planar surface 16 at a distance equal to depth 24.

Figure 4A:
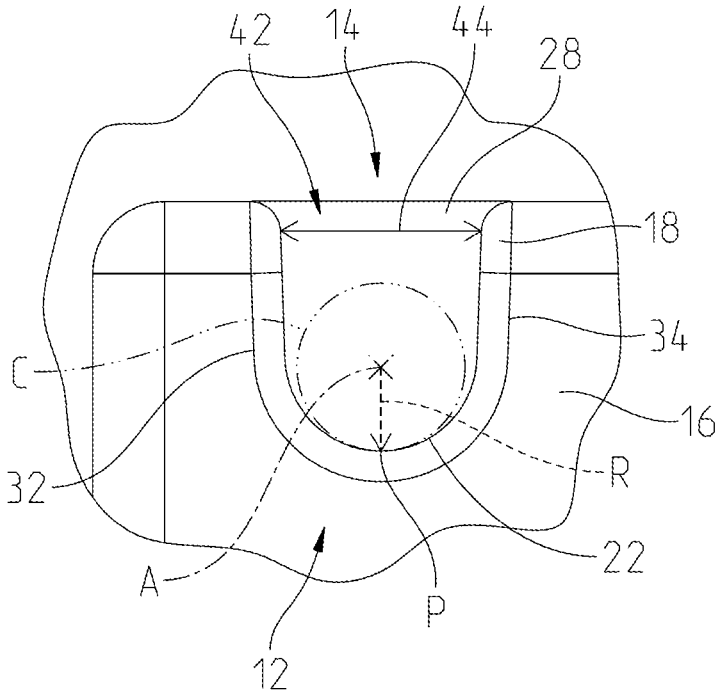
FIG. 4A is a front view of the molded rod mount of FIG. 3.

Referring to FIG. 4A, which illustrates a front view of the recess 14 as shown in FIG. 3, radius of curvature R is at least equal to the radius of the circle C (illustratively about 12.7 mm (0.5 inches)). Circle C represents schematically the placement of rod 30 into recess 14 (i.e., outer circumference of curtain rod 30). Radius of curvature R touches the curved portion 22 of recess 14 at point P and has the same tangent and curvature at that point.

As shown in FIGS. 3 and 4A, recess 14 further includes first and second side portions 32 and 34 extending upward from the curved portion 22, the first and second side portions 32 and 34 having depth 38. In some embodiments, depth 38 is the same or equal to depth 24 of curved portion 22. Recess 14 further includes entry opening 42 disposed between the first side portion 32 the second side portion 34. Illustratively, entry opening 42 extends upwardly. In other illustrative embodiments, entry opening 42 may extend at various angels from vertical. Further, the recess 14 may be of different shapes and dimensions to correspond with rods 30 having varying cross-sections.

Figure 4B:
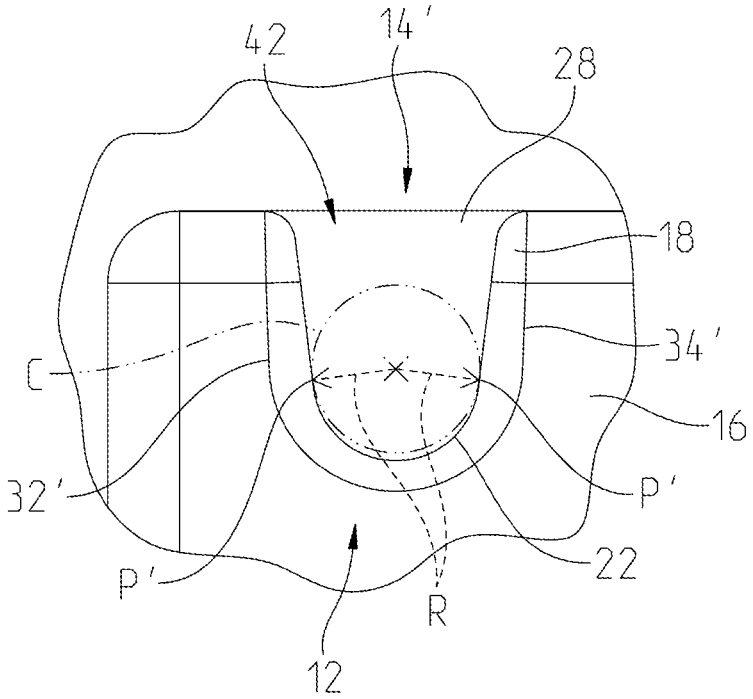
FIG. 4B is a front view similar to FIG. 4A, showing a recess with tapered side portions.

With reference to FIG. 4B, a further illustrative recess 14' is shown as including tapered first and second side portions 32' and 34'. More particularly, first and second side portions 32' and 34' taper inwardly toward each other as they extend downwardly from entry opening 42. At a lower end of the recess 14, the distance between side portions 32' and 34' (illustratively about 22.2 mm (0.875 inches)) is less than the diameter (e.g., twice the radius R)(illustratively about 25.5 mm (1.0 inch)) of the rod 30. As such, the outer surface of the rod 30 engages side portions 32' and 34' at contact points P' before touching the bottom of the recess 14'. The opposing dual contact points P' and gravity help secure the rod 30 within the recess 14' and prevent undesired rattling of the rod 30.

With further reference to FIG. 3, end 31 of the rod 30 may be enlarged to facilitate secure engagement within recess 14. Illustratively, a coupler 43 may be positioned at end 31 of the rod 30 to help secure rod 31 within recess 14. In one illustrative embodiment, coupler 43 may be a resilient ring, such as an elastomeric gasket or grommet.

As further detailed herein, system 20 further illustratively includes a second wall body 112, opposite the first wall body, i.e., wall body 12. The second wall body 112 includes a second recess 114 for providing a second rod mount for receiving second end 33 of rod 30. The first and second recesses 14 and 114 are disposed opposite one another and the molded rod mounts are disposed at the appropriate height H (as shown in FIG. 1) for hanging a standard shower curtain 40 and rod 30. In some illustrative embodiments, the first and second recesses 14 and 114 are substantially the same.

For installing rod 30 into a shower/tub system 10 having first and second recesses 14 and 114, the rod 30 is positioned longitudinally along axis A in a horizontal position from just above the first and second entry openings 42 for releasing into the entry openings for being received by the first and second recesses 14 and 114. The rod 30 is secured by the depth 24 of the curved portions 22 of the respective first and second recesses 14, the depth of opposing molded rod mounts curved portions 22 serving as a ledge support, to hold and fix the rod 30 in place while also providing support for holding the rings 45 and shower curtain 40 onto the rod 30.

Figure 5:
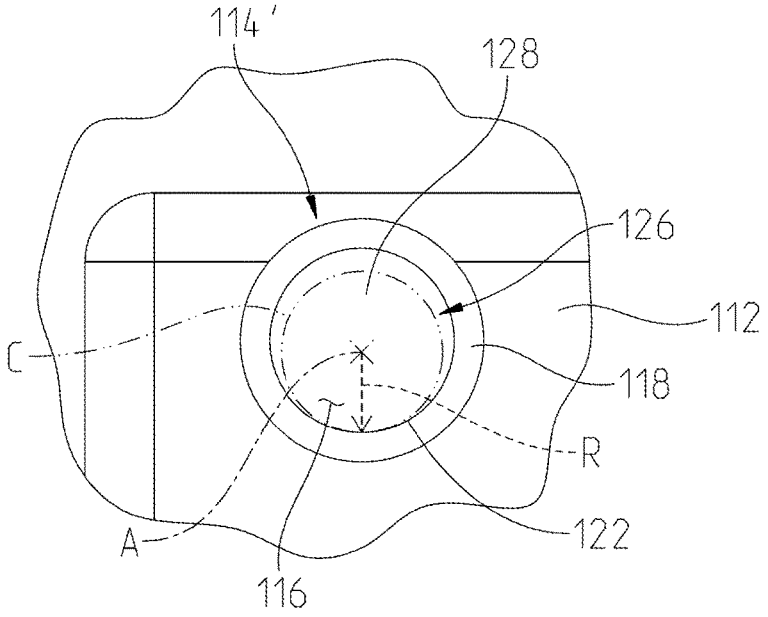
FIG. 5 is a front view of an alternative molded rod mount according to the present disclosure.

In some embodiments, system 20 illustratively includes a recess 14 on a first wall body 12, and an alternate recess 114', as shown in FIG. 5, on a second wall body 112 (see FIG. 1); recess 114' of wall body 112 being disposed opposite recess 14 on wall body 12. FIG. 5 illustrates a front view of alternate recess 114' for a second molded rod mount for shower/tub system 10 opposite the molded rod mount having recess 14 as shown in FIGS. 2-4. In other words, shower/tub system 10 includes recess 14 on wall body 12 of the system 20 and recess 114', the recess 114 shown in FIG. 5, on a second wall body 112 opposite first wall body 12.

Referring again to FIG. 5, recess 114' includes axis A perpendicular to wall body 112 having planar surface 116. Recess 114' includes a curved portion 122 having a depth 124 and a radius of curvature R relative to the axis A. Recess 114' includes a rear portion 126 adjacent to the curved portion 122, wherein rear portion 126 includes a rear surface 128 parallel to and offset relative to wall body planar surface 116 at a distance equal to a predetermined depth. In some embodiments, the predetermined depth is the same or equal to depth 24 of curved portion 22 of recess 14 (FIG. 3).

Radius of curvature R of recess 114 is at least equal to the radius of the circle C, circle representing the placement of a second end of rod 30 into recess 114' (i.e., outer circumference of curtain rod 30). The curved portion 122 of recess 114' is circular.

For installing rod 30 into a shower/tub system 10 having a first recess 14 and a second recess 114', the rod 30 is illustratively angled from axis A (i.e., a horizontal position) to insert second end 33 of rod 30 into the circular recess 114' followed by inserting the first end 31 of rod 30 into the first entry opening 42 of recess 14. The rod 30 is secured by the depth 24 of the curved portion 22 of the first recess 14 supporting the first end 31 of rod 30 and the depth 124 of the curved portion 122 of the second recess 114' supporting the opposite second end 33 of rod 30. The depth of opposing molded rod mounts, having recesses 14 and 114' opposite one another, serve as a ledge support to hold and fix the rod 30 in place while also providing support for holding the rings and shower curtain onto the rod 30.

Wall body 112 having a wall body planar surface 116 may optionally also include at least one additional surface having a decorative contour, e.g., decorative surface 118, adjacent to wall body planar surface 116. Decorative surface 118 provides for aesthetically smooth lines for clean design molded bathing systems according to the present disclosure. For example, decorative surface 118 may be one of rounded, chamfered, beveled, filleted, angled, sloped, and combinations thereof.

In some illustrative embodiments, the entry opening 42 of recess 14 configured to receive the first end 31 of the rod 30 has a width 44 (as shown in FIG. 4) of at least 25 mm (1 inch) or at least 27 mm (1.05 inches) or at least 35 mm (1.38 inches). In some illustrative embodiments the diameter D (as shown in FIG. 5) of circle C of recess 114 is at least 25 mm (1 inch) or at least 27 mm (1.05 inches) or at least 35 mm (1.38 inches). In some illustrative embodiments, the radius of curvature R is about 12.7 mm (0.5 inch). In some illustrative embodiments, the depth 24 is at least 12.7 mm (0.5 inches).

Figure 6:
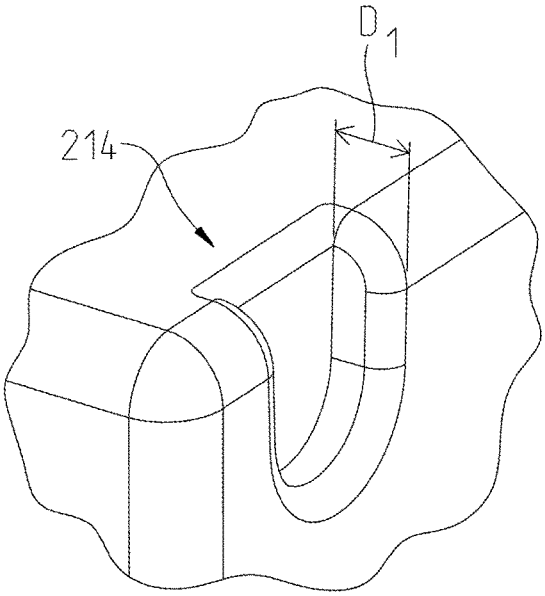
FIG. 6 is a perspective view illustrating dimensions of an example recess.
Figure 7:
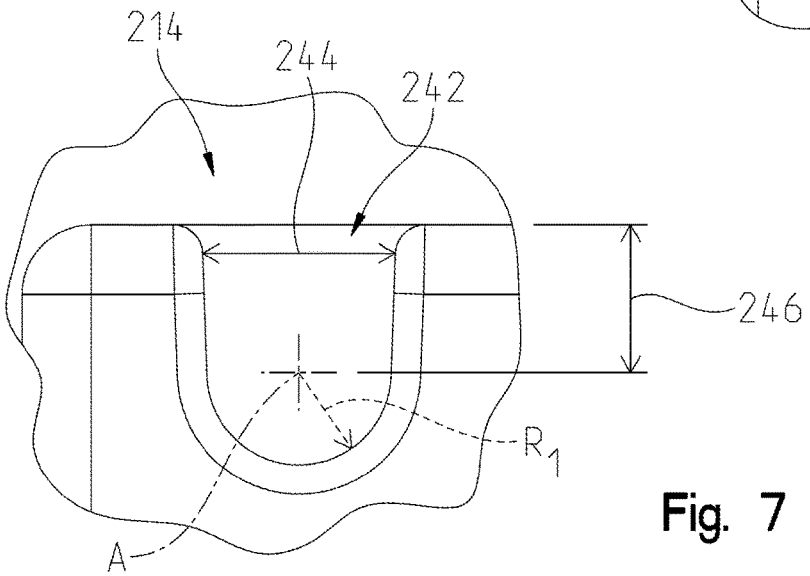
FIG. 7 is a front view illustrating dimensions of the example recess of FIG. 6.

FIG. 6 is a front view and FIG. 7 is a perspective view of an illustrative rod mount including a recess 214 in accordance with the present disclosure. The recess 214 may be either recess 14 or recess 114 formed within the opposing first wall body 12 and second wall body 112. The recess 214 illustratively has a radius of curvature $R_1$ of 12.7 mm (0.5 inch), a length 246 extending from the radius of 20 mm (0.8 inch), a depth $D_1$ of 19 mm (0.75 inches), and entry opening 242 having a width 244 of 27 mm (1.046 inches).

As mentioned, advantageously system 20 including at least one recess 14 is made of a polymer molded in a single, one-piece construction. Alternatively, the system 20 may be formed of multiple molded wall panels or bodies assembled together. System 20 may include a recess 14 on each of two opposing wall bodies or alternatively may include a recess 14 opposite a recess 114. The molded bathing system may comprise a thermoplastic polymer or other suitable material for forming the bathing system as known by those of skill in the art. In some embodiments, the polymer is an acrylonitrile butadiene styrene. In other illustrative embodiments, the system 20 may be formed of acrylic capped high impact polystyrene, crystal capped high impact polystyrene, sheet molded compound material or fiberglass reinforced plastic.

Figure 8:
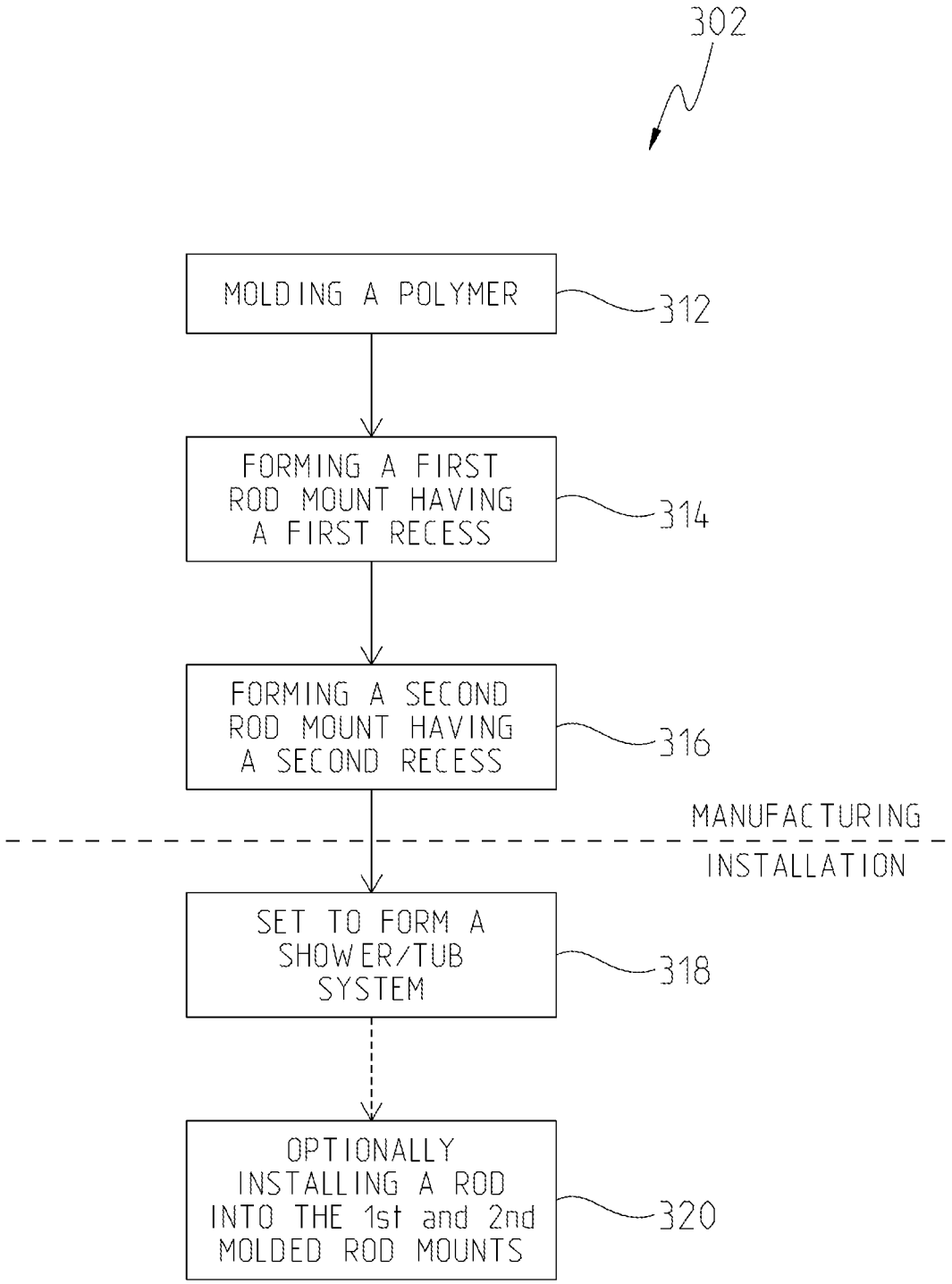
FIG. 8 is a flow chart of an illustrative method of manufacturing the shower system including molded rod mounts of FIG. 1.

FIG. 8 is a flow chart illustrating a method 302 of forming a bathing system 20 for receiving a shower curtain rod 30. The method includes step 312 of molding a polymer to form a bathing wall set or system 20 including at least one molded rod mount. The at least one molded rod mount includes forming a first recess 14 in step 314 configured to receive a first end 31 of the rod 30. The recess 14 of step 314 includes an axis perpendicular to a first wall body 12, a curved portion 22 having a first depth 24, and a radius of curvature R relative to the axis A, and, a rear portion 26 adjacent to the curved portion, the rear portion 26 parallel and offset relative to a first wall body planar surface 16 at a distance equal to the first depth 24.

Step 316 includes forming a second recess 114 for a second molded rod mount. The first and second molded rod mounts are on opposing wall bodies 12, 112, wherein the second molded rod mount is opposite the first molded rod mount and the second recess 114 is opposite the first recess 14. Steps 314 and 316 may occur sequentially or concurrently. More particularly, the first wall body 12 and the second wall body 112 may be molded within a single mold at the same time, or in separate molds at different times.

The recess 14 of step 314 and/or the recess 114 of step 316 may further include first and second side portions 32 and 34 extending upward from the curved portion 22, the first and second side portions 32 and 34 having the first depth. The recess 14 of step 314 and/or the recess 114 of step 316 may further include an entry opening 42 disposed between the first side portion 32 the second side portion 34. After the forming of the recesses 14 and 114 of steps 314 and 316, the mold is set to form a shower/tub system 20 as in step 318.

Optionally the method includes the step 320 of installing the rod 30 in the bathing system 20 by coupling the first and second ends 31 and 33 of the rod 30 to the first and second molded rod mounts. As may be appreciated, steps 312, 314, 316 are considered to be manufacturing process steps, while steps 318, 320 are considered to be installation process steps.

Although the invention has been described in detail with reference to certain preferred embodiments, variations and modifications exist within the spirit and scope of the invention as describe and defined in the following claims.

What is claimed is:

1. A shower system for bracketless mounting of a shower rod comprising:

a first wall body including a first wall body planar surface extending between an upper edge and a lower edge, the lower edge proximate a water collecting surface, a first recess molded within the first wall body planar surface and configured to receive a first end of a rod, the first recess being integral within the first wall body to define a single wall panel extending between the upper edge and the lower edge, the first recess including:

an axis perpendicular to the first wall body;

a first curved portion having a first depth and a first radius of curvature relative to the axis; and, a first rear portion adjacent to the first curved portion, the first rear portion parallel and offset relative to the first wall body planar surface at a distance equal to the first depth;

a second wall body including a second wall body planar surface extending between an upper edge and a lower edge, the lower edge proximate a water collecting surface, a second recess molded within the second wall body planar surface and configured to receive a second end of the rod, the second recess being integral within the second wall body to define a single wall panel extending between the upper edge and the lower edge, the second wall body opposite the first wall body and the second recess opposite the first recess, the second recess including:

the axis perpendicular to the second wall body and to the first wall body;

a second curved portion having a second depth and a second radius of curvature relative to the axis, the second depth equal to the first depth, and the second radius of curvature equal to the first radius of curvature; and, a second rear portion adjacent to the second curved portion, the second rear portion parallel and offset relative to the second wall body planar surface at a distance equal to the second depth; and at least one of:

the first recess further including:

first and second side portions extending upward from the first curved portion, the first and second side portions having the first depth, the first and second side portions extending from the first wall body planar surface to the first rear portion, and the second recess further including:

third and fourth side portions extending upward from the second curved portion, the third and fourth side portions having the second depth, the third and fourth side portions extending from the second wall body planar surface to the second rear portion.

2. The shower system of claim 1, wherein the first recess further includes a first entry opening disposed between the first side portion the second side portion.

3. The shower system of claim 2, wherein the first entry opening is configured to receive the first end of the rod, the first entry opening having a width of at least 35 mm (1.38 inches).

4. The shower system of claim 1, wherein the second recess further includes a second entry opening disposed between the third side portion the fourth side portion.

5. The shower system of claim 4, wherein the second entry opening is configured to receive the second end of the rod, the second entry opening having a width of at least 35 mm (1.38 inches).

6. The shower system of claim 1, wherein at least one of the first recess and the second recess further comprise an additional surface having a decorative contour adjacent to at least one of a first wall body planar surface and a second wall body planar surface.

7. The shower system of claim 1, wherein the first wall body including the first recess and the second wall body including the second recess are molded as portions of a one-piece construction bathing system.

8. The shower system of claim 7, wherein the one-piece construction bathing system comprises a thermoplastic polymer.

9. The shower system of claim 8, wherein the polymer is an acrylonitrile butadiene styrene.

10. The molded rod mount shower system of claim 1, wherein the first radius of curvature is about 12.7 mm (0.5 inch).

11. The shower system of claim 1, wherein the first depth is at least 12.7 mm.

12. A shower wall panel for bracketless mounting of a shower rod including:

a first wall body including a first wall body planar surface extending between an upper edge and a lower edge, the lower edge proximate a water collecting surface, the upper edge being positioned above a shower head, a first recess molded within the first wall body planar surface and configured to receive a first end of a rod, the first recess being integral within the first wall body to define a single wall panel extending between the upper edge and the lower edge, the first recess including:

an axis perpendicular to the first wall body;

a first curved portion having a first depth and a first radius of curvature relative to the axis; and, a first rear portion adjacent to the first curved portion, the first rear portion parallel and offset relative to the first wall body planar surface at a distance equal to the first depth;

the first recess further including:

first and second side portions extending upward from the first curved portion, the first and second side portions having the first depth.

13. The shower system of claim 1, wherein the upper edge of the first wall body is positioned above a shower head.

* * * * *